United States Patent [19]

Beare et al.

[11] 3,988,908

[45] Nov. 2, 1976

[54] DETERGENT DISPENSING APPARATUS FOR WASHING MACHINE

[75] Inventors: Robert Beare; Willis Harlow, both of Herrin; Robert L. Spurgeon, West Frankfurt, all of Ill.

[73] Assignee: Fedders Corporation, Edison, N.J.

[22] Filed: July 24, 1975

[21] Appl. No.: 598,552

[52] U.S. Cl. ..... 68/12 R; 68/17 R; 134/56 D; 134/93; 222/129

[51] Int. Cl.[2] ..... D06F 39/02

[58] Field of Search ..... 68/12 R, 17 R, 17 A, 68/207; 134/56 D, 93; 222/129; 4/227

[56] References Cited

UNITED STATES PATENTS

| | | | |
|---|---|---|---|
| 961,650 | 6/1910 | Schellenberg | 4/227 |
| 2,457,874 | 1/1949 | Davis | 68/17 R X |
| 2,835,122 | 5/1958 | Conlee | 68/17 A |
| 3,019,802 | 2/1962 | Mercer | 134/93 X |
| 3,066,520 | 12/1962 | Jennings | 68/17 R |
| 3,130,738 | 4/1964 | Kays et al. | 68/17 R X |
| 3,724,242 | 4/1973 | Davis | 68/17 A |
| 3,921,421 | 11/1975 | Kretchman et al. | 68/17 R |

*Primary Examiner*—Philip R. Coe
*Attorney, Agent, or Firm*—McAulay, Fields, Fisher & Goldstein

[57] ABSTRACT

The detergent dispensing apparatus is adapted to be used in a washing appliance of the type having a tub for receiving the articles to be washed. The apparatus comprises a detergent storage hopper having a bottom wall opening whereby the hopper stores the detergent and dispenses the same through the bottom wall opening. The hopper is mounted in overlying relationship to the tub so that the detergent is dispensed into the tub. A slide is movably connected to the hopper and is adapted to be moved into and out of registration with the opening. A control device is provided which moves the slide out of registration with the bottom wall opening at a predetermined point in the cycle of operation of the washing machine to permit the detergent therein to be dispensed into the tub. The hopper is removably connected to the appliance so it can easily be removed for cleaning.

19 Claims, 11 Drawing Figures

DETERGENT DISPENSING APPARATUS FOR WASHING MACHINE

This invention relates generally to a detergent dispensing apparatus for a washing machine and, more particularly, pertains to an efficient detergent dispensing apparatus which dispenses detergent stored therein into a washing machine tub at a preselected point in the cycle of operation of the washing machine.

Many washing machines presently on the market require an operator to manually introduce detergent into the washing machine at a desired point in a cycle of operation. Obviously, this method is extremely bothersome to the operator since it requires the operator to be present during the cycle of operation of the machine. In addition, the point in the cycle at which the detergent enters the washing machine varies since it is highly unlikely that an operator will continuously introduce detergent precisely at the correct time in the cycle of operation. Other types of washing machines include devices that store the detergent until the water level in the washing machine tub reaches the storage device, at which point the water mixes with the detergent and causes the detergent to enter the tub. This construction likewise has disadvantages associated with its use since a portion of the detergent may remain within the storage device so that less than a desired amount of detergent will act on the articles to be cleaned.

Accordingly, an object of the present invention is to provide a washing machine having an improved detergent dispensing apparatus.

A more specific object of this invention is to provide a detergent dispensing apparatus for a washing machine that does not require operator assistance after a washing cycle has been initiated.

A further object of the present invention resides in the novel details of construction that provides a detergent dispensing apparatus of the type described that dispenses all the detergent received therein thereby providing a highly accurate dispenser.

Accordingly, a detergent dispensing apparatus constructed in accordance with the present invention is adapted to be used with a washing appliance of the type having a wash receptacle for receiving the articles to be washed. The apparatus comprises detergent storage means, which has a wall opening, for storing the detergent and for dispensing the detergent through the opening. A movable slide is provided for closing the opening and control means that is responsive to a preselected level of water in the receptacle is operable to move the slide to open the wall opening to permit the detergent to be dispensed.

Another problem associated with detergent dispensing apparatus of the type under consideration is the difficulty in cleaning the same since powdered detergent has a tendency to cake. This problem is compounded when water enters the apparatus while detergent is within the apparatus.

Accordingly, a feature of the present invention is to provide an apparatus for dispensing detergent that is easily removable for cleaning purposes and is provided with a lid to prevent water from splashing into the apparatus while detergent is received therein.

Other features and advantages of the present invention will become more apparent from a consideration of the following detailed description when taken in conjunction with the accompanying drawings, in which.

Figure 1:
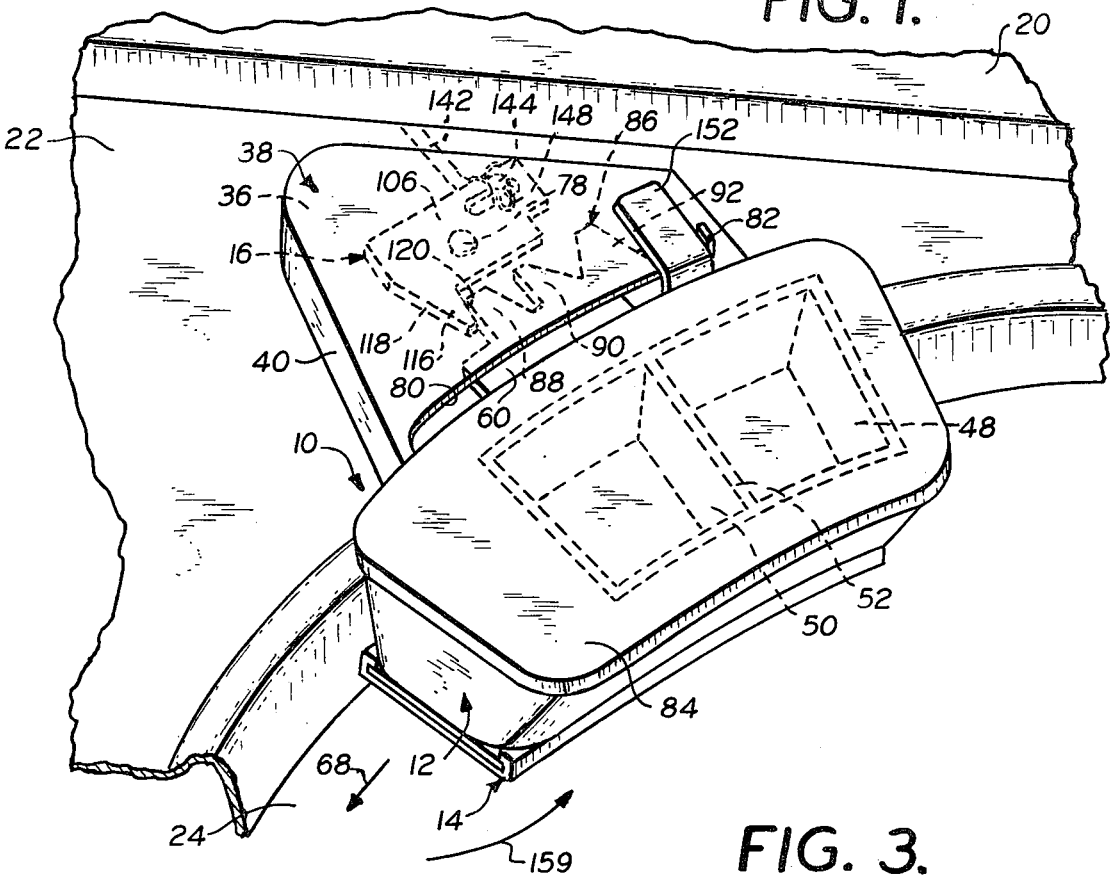
FIG. 1 is a perspective view of a detergent dispensing apparatus constructed according to the present invention, as viewed from the top.
Figure 2:
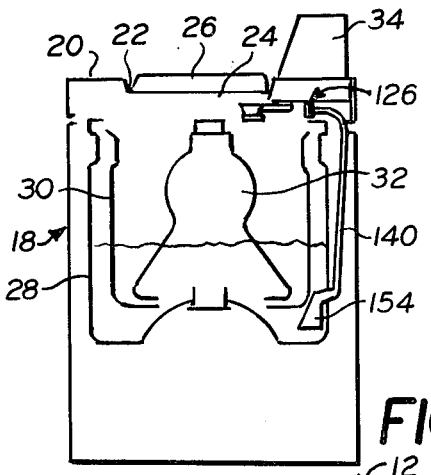
FIG. 2 is a side elevational view of a washing machine utilizing the detergent dispensing apparatus of the present invention with the wall removed and showing the elements in diagrammatic form.

A detergent dispensing apparatus constructed according to the present invention is designated generally by the reference character 10 in FIG. 1 and basically comprises a hopper or detergent storage device 12, a slide 14 that is adapted to open and to close bottom openings in the hopper 12 to control the dispensing of the detergent, and a control device designated generally by the reference character 16 that controls the movement of the slide 14. The apparatus 10 is adapted to be utilized in a washing machine of the type shown diagrammatically in FIG. 2.

More specifically, the washing machine 18 includes a top wall 20 having a recessed central portion 22 provided with an opening 24. A cover or clothes door 26 is hingedly connected to the wall 20 and may be opened to permit access to the interior of the machine through the opening 24. Provided within the machine is a tub 28 that receives a rotatable perforated tub or receptacle 30 that is adapted to receive the materials to be washed. Additionally, the tub 30 is adapted to receive the wash water and the detergent. Mounted within the tub 30 is an oscillating impeller 32 that is adapted to circulate the water and the materials to be washed. A control console 34 is upstanding from the top surface of the washer. The washing machine thus far described is conventional in construction.

The apparatus 10 of the present invention is adapted to be mounted on the top wall 20 of the washing machine cabinet, as noted in detail below. The hopper 12 is sized and positioned so that it will extend over the open top of the tub 30. Thus, when detergent is dispensed from the hopper 12, it will fall directly into tub 30. Additionally, the upper portion of the hopper 12 underlies the clothes door 26 and is accessible upon opening of the door to permit the hopper to be filled with detergent.

Figure 9:
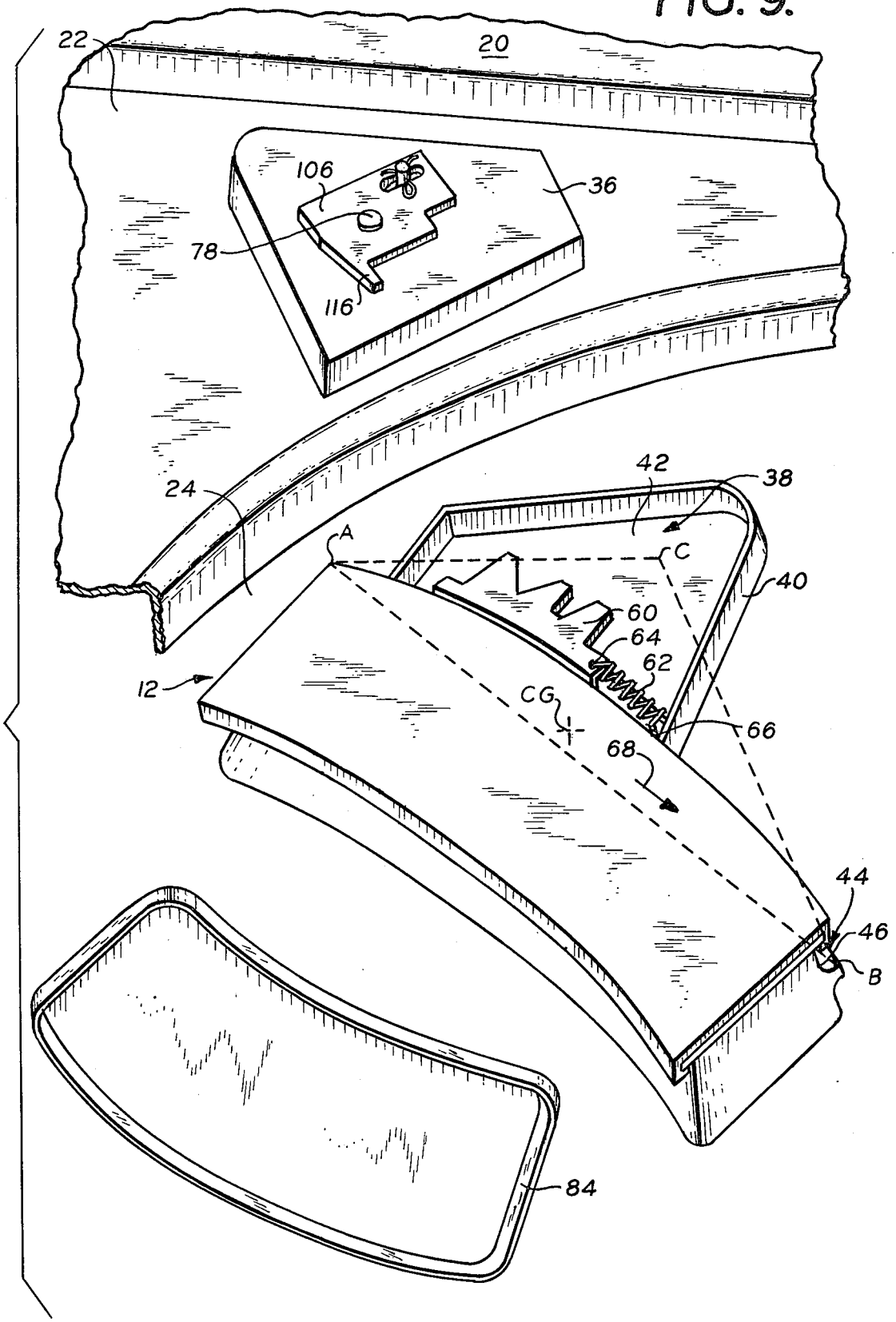
FIG. 9 is an exploded view of the detergent dispensing apparatus shown in FIG. 1 illustrating the detergent storage device in inverted relationship with respect to the mounting support.

As shown in greater detail in FIGS. 1 and 9, the apparatus 10 includes an irregularly shaped member 36 received in the recess 22 and upstanding from the bottom wall thereof and positioned adjacent the opening 24. The hopper 12 includes a rearwardly extending member 38 (FIG. 9) having a depending peripheral flange 40 that defines a recess 42 having substantially the same shape as the irregularly shaped member 36. As shown more clearly in FIG. 1, the member 36 is received in the recess 42 in a relatively tight sliding fit thereby to removably connect the hopper with the machine 18. The member 38 is sized so that the detergent dispensing sections of the hopper are received within the opening 24 so that the detergent dispensed therefrom will fall into the tub 30.

The weight of the hopper 12 aids in maintaining the hopper in position on the cabinet. To be more specific, the rear wall 44 is provided with curved surfaces 46 that extend along the rear wall for short distances. The surfaces 46 are positioned adjacent the respective side edges of the hopper. The surfaces 46 are adapted to mate with the surface of the recess 22 defining the opening 24 to support the hopper.

That is, as shown in FIG. 9, the surfaces 46 are provided at points A and B on the hopper 12. Moreover, the center of gravity CG of the hopper is designed to lie between a line joining points A and B and the rear wall 44 of the hopper regardless of whether the hopper is empty or full of detergent. As a result, when the hopper is mounted on the cabinet a turning moment arises about the mounting points A and B in a counterclockwise direction, as indicated by the arrowhead 159 in FIG. 1. This action causes the member 38 to remain firmly in contact with the support member 36 to provide another point of suspension C for the hopper thereby eliminating the need for permanent fastening elements between the hopper and the cabinet. An upper curved surface 47 is provided along the rear wall 44 of the hopper 12 for cosmetic purposes. The surface 47 overlies the cabinet so no space is visible between the hopper and the cabinet per se.

This mounting arrangement permits the easy removal of the hopper 12 for cleaning or the like. That is, the hopper may be separated from the member 36 simply by lifting upwardly until the member 36 clears the recess 42.

Figure 7:
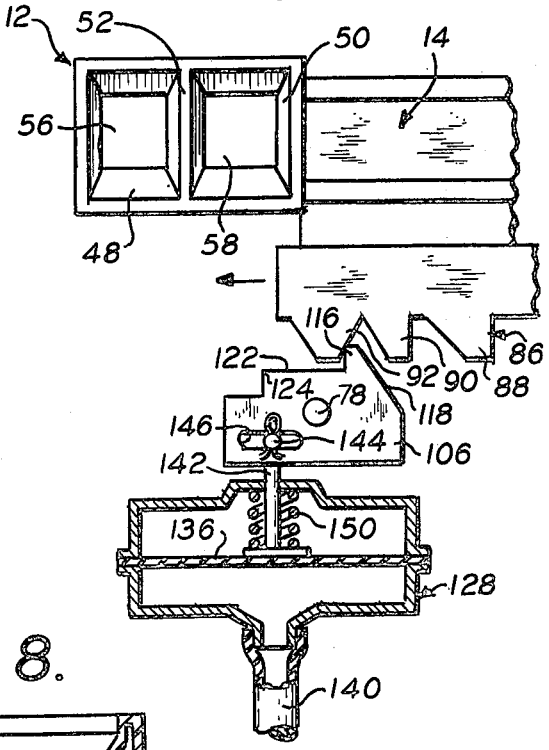

The hopper 12 comprises sections 48 and 50 that are separated by an intermediate wall 52. The front wall 54 (FIG. 8) of the hopper tapers downwardly and inwardly to facilitate emptying of the sections or compartments 48 and 50 of detergent. As shown in FIG. 7, each one of the sections 48 and 50 is provided with a bottom wall opening 56 and 58, respectively, through which detergent is adapted to exit. In other words, the bottom wall openings 56 and 58 are normally closed by the slide 14 and are adapted to be opened as the slide 14 is moved to permit the detergent to exit through the bottom wall openings and fall into the tub.

The slide 14 comprises a member having an upper rearwardly extending horizontal portion 60 (FIG. 9) that projects into the recess 42 and which overelies the top surface of the member 36 when the member 36 is received in the recess (See FIG. 1). One end of a spring 62 is connected to the slide portion 60 and 64 (FIG. 9) and the other end of the spring is connected to the hopper 12 and 66. The spring 62 is operable to bias the slide 14 in the direction indicated by the arrowhead 68 so that under normal conditions the slide is moved to a position wherein the bottom openings of the hopper 12 are uncovered, as noted in greater detail below.

Figure 8:
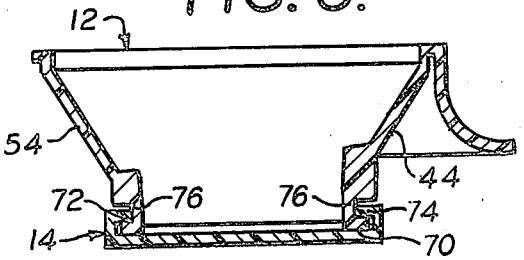
FIG. 8 is a vertical sectional view of the detergent storage device of the present apparatus as seen looking from the right as taken in FIG. 1.

The slide 14 is provided with a channel 70. That is, as shown in FIG. 8, the forward end of the slide is provided with opposed longitudinally extending ears 72 and 74 that define the channel 70. Respective grooves 76 are provided on the hopper 12 adjacent the bottom thereof that receive the ears 72 and 74 to slidingly connect the slide 14 with the hopper and maintain the slide in close proximity to the bottom wall of the hopper 12.

The control device 16 includes a rack 86 at the rear edge of the upper portion 60 of the slide 14. As shown in the FIGS., the rack 86 comprises teeth 88–92. As shown more clearly in FIG. 3, the forward edges 94 and 96 of respective teeth 88 and 90 are straight whereas the respective rear edges 98 and 100 taper forwardly toward the left as taken in the Figure. On the other hand, the forward edge 102 of the tooth 92 tapers forwardly toward the right, as taken in FIG. 3 and the rear edge 104 thereof tapers forwardly toward the left.

A pawl 106 is mounted adjacent the rack 86 for pivotal movement into and out of engagement with the rack teeth. That is, a pivot pin 78 is provided on the member 36 which rotatably receives the pawl 106. The pawl 106 is provided with a projection or tooth 116 at the front end thereof. The front or forward edge 118 of the tooth 116 tapers forwardly, toward the left, as taken in FIG. 3 and the rear edge 120 is substantially straight. The rear edge of the pawl is notched at 122 to define a projection 124. The pawl is adapted to be pivoted about the pin 78 so that the tooth 116 may be moved into and out of engagement with the teeth 88-90 of the rack 86. Movement of the pawl is controlled by a pressure actuated device designated generally by the reference numeral 126.

The pressure actuated device 126 includes a transducer 128 (FIG. 3) comprising a housing having a front member 130 and a rear member 132 connected together along a seam 134 and clamping the outer edge of a resilient diaphragm 136 therebetween at their peripheral edges. The member 132 includes an inlet 138 that is connected to an airbell 154 (FIG. 2) by a conduit 140. Connected to the central portion of the diaphragm on the side opposite the side facing the inlet 138 is a lever 142. The lever 142 extends through member 130 and terminates in an upturned portion 144 that is received in an elongate slot 146 in the pawl 106. A cotter pin 148 extends through the end of the upturned portion of the pin 142 to retain the portion 144 in the slot 146. A spring 150 extends about the lever 142 and bears against the member 130 at one end and the diaphragm 136 at the other end to bias the diaphragm to the position shown in FIG. 3. For this arrangement of elements, the tooth 116 of the pawl 106 will be in engagement with the rack 86. The transducer 128 may be mounted on the underside of the top wall 20 by any conventional means.

When water enters the perforated tub 30 and tub 28, a column of water likewise enters the airbell 154. The water compresses the air within the airbell 154 and conduit 140 and thereby causes an increased pressure to be applied to the diaphragm 136. The diaphragm thereby is caused to move forwardly, as noted in greater detail below, thereby pivoting the pawl to cause the tooth 116 to move out of engagement with the rack 86.

A handle 152 is upstanding from the portion 60 of the slide 14 and extends through an elongated slot 80 in the member 38 and permits the operator to move the slide to the right, as taken in FIG. 1. A raised stop 82 (FIG. 1) is provided on the member 38 and is adapted to engage the handle 152 thereby to limit movement of the slide 14 beyond a desired point. Additionally, a cover 84 is provided for closing the open top of the compartments or sections 48 and 50. The cover may be removable as shown, or it may be hingedly connected to the hopper 12.

In operation, assuming that the elements are in the positions indicated in FIG. 1, the operator removes the cover 84 and fills sections 48 and 50 of the hopper 12 with detergent. She thereafter replaces cover 84 and closes the cover 26 of the washing machine 18 and adjusts the controls so that the machine performs the desired cycle of operation.

Figure 3:
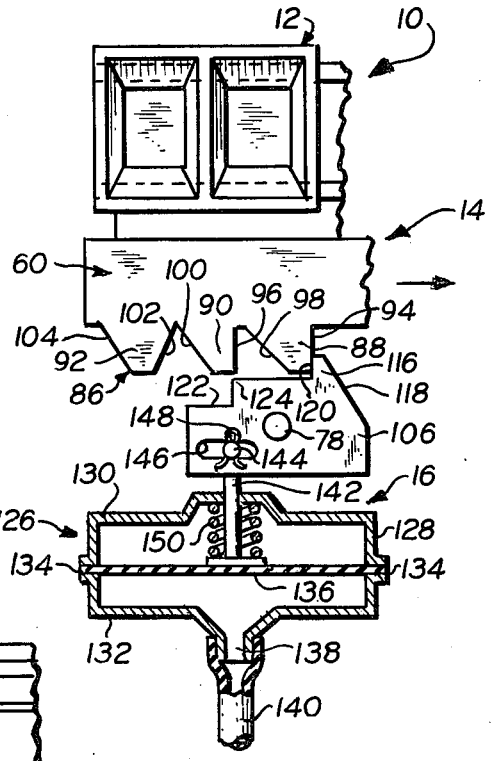
FIG. 3 is a top plan view, partially in section, of the apparatus shown in FIG. 1, with parts broken away and showing the operative portions thereof.
Figure 10:
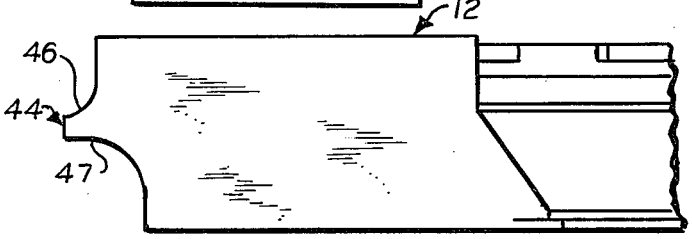
FIG. 10 is a side elevational inverted view, with parts broken away, of the hopper portion of the detergent storage device.

The elements comprising the control device 16 will be in the position shown in FIG. 3, wherein the tooth 116 of the pawl 106 is in engagement with the forward edge 94 of the tooth 88 of the rack. The slide 14 will be in registry or will be closing the bottom openings 56 and 58 of the hopper 12.

As the water begins to enter the tub 28, and the level thereof increases, an increased pressure will be exerted on the diaphragm 136. The diaphragm 136 will accordingly begin to move forwardly until the diaphragm will assume the position shown in FIG. 4 when the water has reached a preselected level. That is, as the diaphragm 136 moves forwardly, the lever 142 likewise moves forwardly against the bias of the spring 150 and thereby causes the pawl 106 to rotate about the pin 78 in a direction indicated by the arrowhead 156. This rotation will continue until the tooth 116 moves out of engagement with the tooth 88 of the rack 86. This disengagement will occur when the water level in the tub has reached a preselected level. In other words, the length of the tooth 116 is such that the pressure required to move the diaphragm to cause disengagement will correspond to a predetermined level of water in the tub 28.

Figure 4:
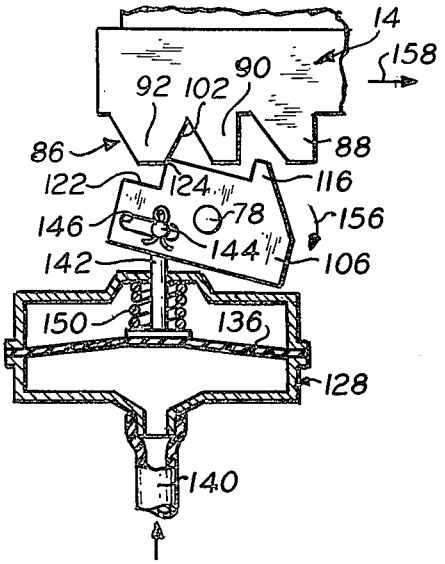
FIGS. 4–7 are top plan views of the apparatus of the present invention similar to FIG. 3 showing the sequential operation of the elements comprising the apparatus.

As the tooth 116 moves out of engagement with the tooth 88, the spring 62 causes the slide 14 to move in the direction indicated by the arrowhead 158. However, as shown in FIG. 4, when the tooth 116 has been moved out of engagement with the rack, the projection 124 at the other end of the pawl will move into the space between teeth 90 and 92 and will engage tooth 92. Accordingly, movement of the rack in the direction of the arrowhead 158 will thereby be arrested.

Figure 5:
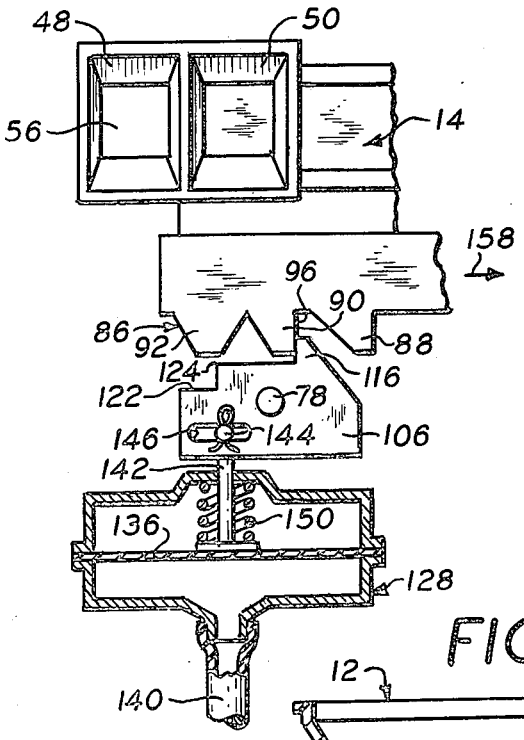

The spacing between teeth on the rack 86 is related to the spacing between the bottom openings of the hopper 12. Thus, when the tooth 92 has advanced to a position wherein it abuts the projection 124, the bottom opening 56 of the section 48 of the hopper 12 will have been uncovered by the slide 14, as shown in FIG. 5. Accordingly, the detergent in the section 48 will be dispensed through the opening 56 into the tub 30.

As the water level recedes, the pressure against the rear of the diaphragm 136 will decrease and the spring 150 will bias the diaphragm back to its normal position, as shown in FIG. 5. Hence, the pawl 106 will rotate about the pivot pin 78 in the counterclockwise direction to its normal position shown in FIG. 5. The projection 124 will move out of engagement with the tooth 92 and the tooth 116 on the pawl 106 will move into the space between the teeth 88 and 90. Thus, the slide 14 will again advance in a direction shown by the arrowhead 158, under the influence of the spring 62, until the tooth 90 of the rack 86 engages the tooth 116 of the pawl thereby arresting further movement. The elements are dimensioned however, so that the slide 14 will not uncover the opening 58, even though the slide has advanced slightly so that the tooth 116 engages the tooth 90.

Figure 6:
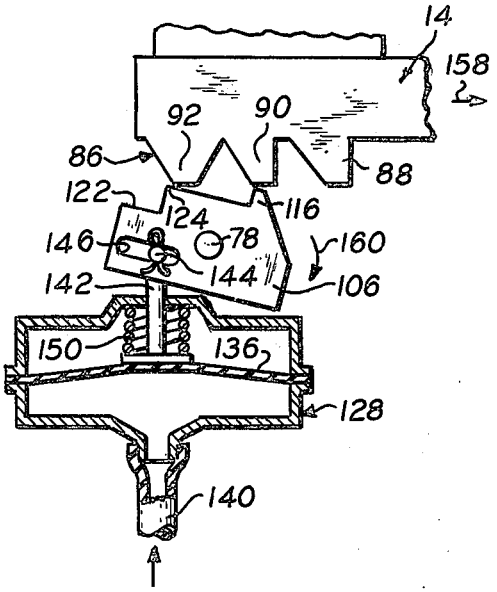

During the next fill portion of the cycle, the increased pressure on the diaphragm 136 will again cause the pawl 106 to pivot in the direction of the arrowhead 160, as shown in FIG. 6. However, since there are no further teeth comprising the rack 86, no tooth will engage the projection 124. Accordingly, as the tooth 116 of the pawl 106 disengages the tooth 90 of the rack, the rack will advance in the direction of the arrowhead 158 to the full extent permitted by the slot 80. In other words, the slide 14 will advance to the position shown in FIG. 7. At this point, the bottom opening 58 will be uncovered by the slide thereby permitting the detergent within the section 50 of the hopper to be dispensed into the tub. Similarly to the first fill portion of the cycle, the detergent will therefore be dispensed when the level of water in the tub has reached the preselected level. After the water is removed from the tub, the pawl 106 will again be rotated back to its normal position as shown in FIG. 7.

When it is desired to ready the washing machine for the next cycle of operation, the handle 152 is grasped by the operator and the slide is moved toward the right, as taken in FIG. 1, until the handle abuts the stop 82. Thus, the tapering edge 104 of the tooth 92 will engage the tapering front edge 118 of the pawl 106, thereby causing the pawl to rotate in the clockwise direction and out of engagement with the teeth of the rack 86. Since the rear edges of the other teeth 88 and 90 of the rack 86 are similarly tapered, the pawl will be moved out of engagement with the teeth as the slide is moved back to the position shown in FIG. 1, wherein all of the bottom openings of the hopper are closed. Once the tooth 116 of the pawl has cleared the tooth 88 of the rack, the pawl will move back into engagement with the tooth 88 thereby preventing the slide from moving in the direction of the arrowhead 158. Hence, the hopper 12 may be again filled with detergent after removal of the cover 84 and the cycle of operation of the washing machine repeated.

Accordingly, a washing machine having detergent dispensing apparatus has been disclosed wherein the apparatus is extremely reliable to dispense detergent at a predetermined point in the cycle of operation of the washing machine.

As noted above, the present invention also permits the easy cleaning of hopper 12. That is, if the detergent begins to cake, the hopper 12 and slide 14 may be removed as a unit simply by lifting the hopper upwardly until the member 38 clears the support member 36. The elements 12 and 14 may then be cleaned and may be replaced by fitting the member 38 over the member 36 and moving the hopper downwardly until the member 36 is received within the recess 42. This arrangement also permits the easy replacement or repair of the elements 12 and 14.

Figure 11:
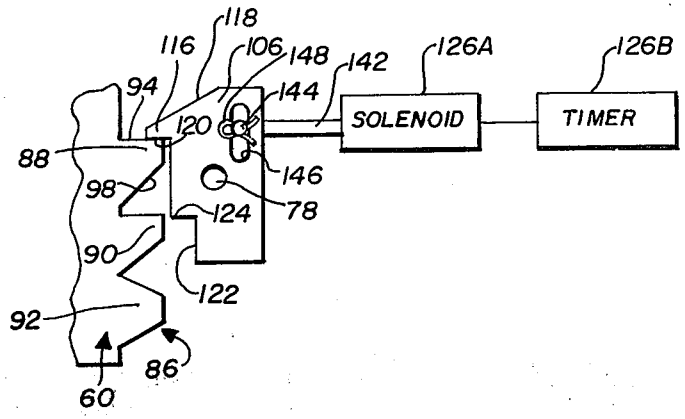
FIG. 11 is a schematic diagram, partially in block form and with parts broken away, of a modified embodiment of the invention showing an alternate control arrangement.

While a preferred embodiment of the invention has been shown and described herein, it will become obvious that numerous omissions, changes and additions may be made in such embodiment without departing from the spirit and scope of the present invention. For example, the hopper 12 may comprise only one section or more than two sections, depending upon the number of times it is desired to dispense detergent during the cycle of the washing machine. Moreover, if desired, the diaphragm arrangement may be replaced by a solenoid (126A FIG. 11) that is connected to the pawl 106, by the lever 142. The solenoid is connected to and operated by a conventional timer device 126B that controls the cycle of operation of the appliance. This latter arrangement ensures that the detergent will be dispensed at the same point in time during each cycle of operation.

What is claimed is:

1. Detergent dispensing apparatus for a washing appliance having a wash receptacle for receiving articles to be washed, said apparatus comprising:

detergent storage means having a bottom wall opening for storing the detergent and for dispensing the detergent through said opening;

a movable slide for closing said opening;

and control means responsive to a preselected level of water in the receptacle for moving said slide to open said wall opening to permit the detergent to be dispensed;

said storage means including a hopper positioned in overlying relationship to said receptacle;

said hopper including a plurality of compartments each having a respective bottom opening;

said slide comprising a bottom slide movable into and out of registration with each of said bottom openings;

and said control means comprising stepping means for sequentially moving said slide out of registration with said bottom openings each time the water level reaches said preselected level.

2. Detergent dispensing means as in claim 1, in which said hopper is provided with opposed grooves adjacent the bottom thereof, said slide being channel-shaped in cross-section and having opposed ears respectively received in said grooves to movably connect together said slide and said hopper.

3.. Detergent dispensing apparatus as in claim 1, in which said control means includes a spring for biasing said slide out of registration with said bottom opening.

4. Detergent dispensing apparatus as in claim 1, in which said hopper comprises a plurality of sections each having a respective bottom opening, and said rack includes a plurality of teeth, each tooth of said rack being spaced from the next adjacent tooth by a distance corresponding to the distance between adjacent bottom openings, said pawl having a front member pivotable into and out of engagement with the teeth on said rack, and a rear member pivotable into engagement with said rack teeth when said front member is pivoted out of engagement with said rack teeth to limit movement of said slide to uncover only one of said plurality of bottom openings each time the water level reaches said preselected level.

5. Detergent dispensing apparatus as in claim 4, and a handle connected to said slide for manually moving said slide to a position wherein said bottom openings are covered.

6. Detergent dispensing apparatus as in claim 1, in which said hopper has an open top, and a removable cover for covering said hopper open top.

7. Detergent dispensing apparatus as in claim 1, and mounting means for removably mounting said hopper on the washing appliance, said mounting means comprising a support member mounted on the appliance, and an extension on said hopper having a recess formed complementary to said support member for receiving said support member therein.

8. Detergent dispensing apparatus as in claim 7, in which said hopper includes a rear wall, and said mounting means further includes spaced support surfaces on the rear wall of said hopper resting on said appliance to support said hopper thereon, said hopper having a center of gravity located between a line joining said support surfaces and said rear wall of said hopper, whereby a turning moment is generated about said line to force said extension into contact with said support member.

9. Detergent dispensing apparatus for a washing appliance having a wash receptacle for receiving articles to be washed, said apparatus comprising:

detergent storage means having a bottom wall opening for storing the detergent and for dispensing the detergent through said opening;

a movable slide for closing said opening;

and control means responsive to a preselected level of water in the receptacle for moving said slide to open said wall opening to permit the detergent to be dispensed;

said storage means comprising a hopper positioned in overlying relationship to said receptacle;

said slide comprising a bottom slide movable into registration with said opening to close said opening, and movable out of registration with said opening to permit detergent to fall therethrough;

said control means includes a rack having a plurality of teeth on said slide, a spring for biasing said slide to a position wherein said slide is out of registration with said opening and a pawl engageable with the teeth comprising said rack to maintain said slide in position against the bias of said spring, and moving means responsive to said preselected level of water for moving said pawl out of engagement with said rack, whereby said slide moves out of registration with said bottom opening.

10. Detergent dispensing apparatus as in claim 9, in which said moving means comprises a diaphragm within a housing a lever connecting said diaphragm and said pawl, and conduit means connecting said housing with the bottom of the receptacle for applying increased pressures due to the rise of water in the receptacle against said diaphragm and lever to rotate said pawl to release said rack.

11. A washing appliance having a receptacle provided with an opening for receiving articles to be washed therethrough; detergent dispensing apparatus on said appliance for dispensing detergent into said receptacle; said apparatus comprising:

detergent storage means having at least a bottom opening overlying said receptacle for dispensing detergent received therein through said bottom opening into said receptacle, a slide movable between a first position wherein said slide closes said bottom opening and a second position wherein said slide uncovers said bottom opening;

and control means for moving said slide to said second position at a predetermined point in the cycle of operation of said appliance, said detergent storage means comprising a hopper having a plurality of sections, each of said sections having a respective bottom opening, said slide closing all of said bottom openings when in said first position and uncovering respective ones of said bottom openings as said slide is moved to corresponding respective intermediate positions between said first and second positions, said control means including a rack connected to said slide, said rack having a plurality of teeth wherein each tooth is spaced from the next adjacent tooth by a distance corresponding to the distance between adjacent bottom openings of said plurality of sections, and a pawl mounted for pivotal movement, said pawl having a first member pivotable into and out of engagement with said teeth and a second member pivotable into engagement with said rack teeth when said first member is pivoted out of engagement with said rack teeth to limit movement of said slide to one tooth at a time, and sensing means responsive to predetermined points in the cycle of operation of said appliance for pivoting said pawl each time one of said predetermined points in the cycle of operation of said appliance is reached.

12. A washing appliance as in claim 11, and timing means for controlling said appliance through a cycle of operation, said timing means being operable to generate a control signal at said predetermined point S in the cycle of operation of said appliance, said control means comprising a solenoid connected to said slide and responsive to said control signal for moving said slide to said second position.

13. A washing appliance having a receptacle provided with an opening for receiving articles to be washed therethrough; detergent dispensing apparatus on said appliance for dispensing detergent into said receptacle; said apparatus comprising:

detergent storage means having at least a bottom opening overlying said receptacle for dispensing detergent received therein through said bottom opening into said receptacle;

a slide movable between a first position wherein said slide closes said bottom opening and a second position; wherein said slide uncovers said bottom opening;

said detergent storage means comprising a hopper having a plurality of sections, each of said sections having a respective bottom opening, said slide closing all of said bottom openings when in said first position and uncovering respective ones of said bottom openings as said slide is moved to corresponding respective intermediate positions between said first and second positions; and stepping means for sequentially moving said slide to said intermediate positions each time the water level in said receptacle reaches a preselected level.

14. A washing appliance as in claim 13, and mounting means for removably mounting said detergent storage means on said appliance, said mounting means comprising an irregularly shaped support block mounted adjacent said receptacle opening, and an extension on said detergent storage means having a recess conforming to the shape of said block for removably receiving said block therein.

15. A washing appliance as in claim 14, in which said detergent storage means comprises a rear wall, said mounting means further including spaced support surfaces on said rear wall resting to rest on said appliance to support said detergent storage means thereon, said detergent storage means having a center of gravity located between a line joining said support surfaces and said rear wall, whereby a turning moment is generated about said line to force said extension into contact with said irregularly shaped member.

16. A washing machine as in claim 13, in which said detergent storage means has an open top, and a cover for closing said open top.

17. A washing appliance as in claim 13, in which said control means includes biasing means for normally biasing said slide to said second position.

18. A washing appliance as in claim 13, in which said stepping means comprises a rack connected to said slide, said rack having a plurality of teeth wherein each tooth is spaced from the next adjacent tooth by a distance corresponding to the distance between adjacent bottom openings of said plurality of sections, and a pawl mounted for pivotal movement by said sensing means, said pawl having a first member pivotable into and out of engagement with said teeth, and a second member pivotable into engagement with said rack teeth when said first member is pivoted out of engagement with said rack teeth to limit movement of said slide to one tooth at a time, whereby only one bottom opening is uncovered each time the water level reaches said preselected level.

19. A washing appliance as in claim 18, in which said rack teeth and said pawl have complementary formed sloping teeth surfaces which cause movement of said pawl out of engagement with said rack teeth as said slide is moved to said first position, and a handle connected to said slide for moving said slide to said first position.

* * * * *